United States Patent [19]

Schildkraut et al.

[11] Patent Number: 4,536,048

[45] **Date of Patent: * Aug. 20, 1985**

[54] ANTI-DECOUPLING MECHANISM FOR AN ELECTRICAL CONNECTOR ASSEMBLY

[75] Inventors: Alan L. Schildkraut, Sidney; David W. MacAvoy, Bainbridge, both of N.Y.

[73] Assignee: Allied Corporation, Morristown, N.J.

[ * ] Notice: The portion of the term of this patent subsequent to Apr. 2, 2002 has been disclaimed.

[21] Appl. No.: 493,498

[22] Filed: May 11, 1983

[51] Int. Cl.[3] ..... H01R 6/23

[52] U.S. Cl. ..... 339/89 M; 339/DIG. 2

[58] Field of Search ..... 339/89 R, 89 C, 89 M, 339/90 R, 90 C, DIG. 2; 285/82, 89, 92; 267/156; 192/72, 81 C

[56] References Cited

U.S. PATENT DOCUMENTS

| | | | |
|---|---|---|---|
| 718,366 | 1/1903 | Freund | 83/345 |
| 957,504 | 5/1910 | Frenot | 411/143 |
| 1,011,871 | 12/1911 | Smoke | 411/331 |
| 2,928,514 | 3/1960 | Clausing et al. | 192/81 C |
| 3,018,097 | 1/1962 | Johansson | 267/156 |
| 3,222,046 | 12/1965 | Thorner | 267/156 |
| 3,517,371 | 6/1970 | Buckley | 339/89 |
| 3,532,197 | 10/1970 | King | 267/156 |
| 3,594,700 | 7/1971 | Nava | 339/89 R |
| 3,598,210 | 8/1971 | Barr | 192/72 |
| 3,646,495 | 2/1972 | Cowmeadow | 339/46 C |
| 3,663,926 | 5/1972 | Brandt | 339/89 R |
| 3,669,472 | 6/1972 | Nadsady | 339/89 R |
| 3,786,396 | 1/1974 | Kemmer | 339/89 R |
| 3,801,954 | 4/1974 | Dorrel | 339/90 R |
| 3,917,373 | 11/1975 | Peterson | 339/89 R |
| 3,971,614 | 7/1976 | Paoli et al. | 339/89 |
| 4,007,953 | 2/1977 | Powell | 339/89 R |
| 4,030,798 | 6/1977 | Paoli | 339/89 R |
| 4,056,298 | 11/1977 | Cooper | 339/89 M |
| 4,066,315 | 1/1978 | Arneson | 339/89 M |
| 4,165,910 | 8/1979 | Anderson | 339/89 M |
| 4,359,255 | 11/1982 | Gallusser et al. | 339/90 R |
| 4,427,100 | 1/1984 | Rude et al. | 192/81 C |
| 4,437,552 | 3/1984 | Toyama | 192/81 C |

*Primary Examiner*—John McQuade

*Attorney, Agent, or Firm*—C. D. Lacina

[57] ABSTRACT

An annular, radially expansible/contractible, spiral spring (50) includes a cantilever arm (51) provided with a distal locking tab (60), the spring being interference fit in an annular groove (26) of a plug shell (20) to both mount a coupling nut (30) thereon and provide means for resisting rotation of the coupling nut in both directions, the tab (60) being adapted to engage a contiguous succession of ratchet teeth (40) disposed annularly around a cylindrical hub (36) extending coaxially from the coupling nut, external coupling torque tending to expand the spring whereby the spring slides about the groove and external uncoupling torque tending to contract the spring and tighten the spring fitment around the plug shell, increased torque driving tab (62) and arm (60) radially outward from the ratchet tooth to allow coupling nut rotation.

6 Claims, 7 Drawing Figures

FIG. 6
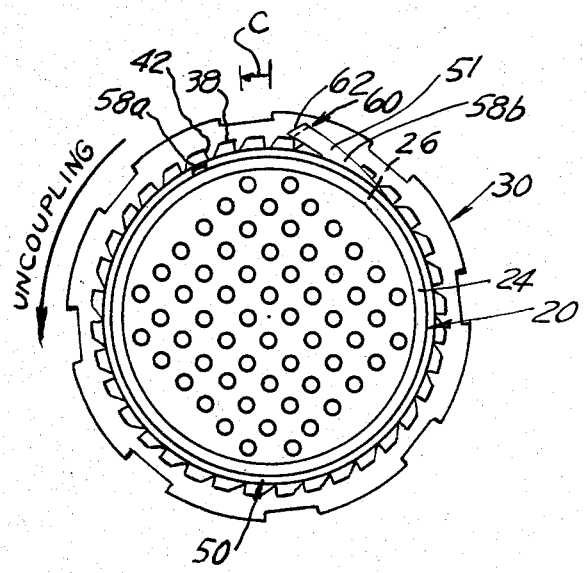
FIG. 7
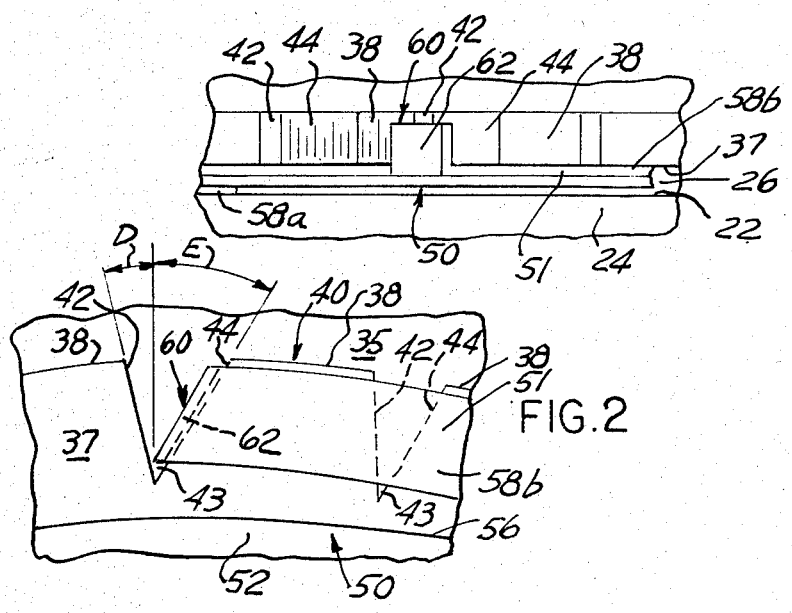
FIG. 2

ANTI-DECOUPLING MECHANISM FOR AN ELECTRICAL CONNECTOR ASSEMBLY

This invention relates to an anti-decoupling mechanism for an electrical connector assembly.

Devices for resisting rotation of a coupling nut due to vibration have utilized a spring-detent approach. In "Electrical Connector Assembly Having Anti-Decoupling Mechanism" U.S. Pat. No. 4,109,990 issuing Aug. 29, 1978 to Waldron et al., a straight spring beam has its opposite ends mounted to an inner wall of a coupling nut and a medial tooth portion thereon tangent to and adapted to successively engage with ratchet teeth formed on one of the two connectors when the coupling nut is rotated in either direction relative to the connector assembly. A disadvantage of the spring-detent is constant wearing between teeth and possible nut rotation of one or two ratchet clicks to introduce slight axial back-off of the shells from their full mating which could lead to shell hammering and/or adverse radio frequency interference.

An annular ring comprising a flat band of metal wound about itself a couple of times such that opposite ends thereof are overlapping has been used to rotatably mount a coupling nut to its respective connector shell, the ring only serving to retain (i.e., longitudinally captivate) the coupling nut about its shell. It would be desirable to combine rotation resisting and retaining functions to thereby eliminate parts and reduce overall assembly time.

This invention is an anti-decoupling mechanism for an electrical connector assembly of the type comprising plug and receptacle connectors and a coupling nut including a radial flange rotatably mounted on the plug connector such that an outer end wall of the flange is facing rearwardly, the plug connector including an annular groove having an end wall facing forwardly and an annular flange for the radial flange to abut.

The anti-decoupling mechanism is characterized by a contiguous plurality of ratchet teeth disposed annularly around a cylindrical hub extending coaxially rearward from the end wall of the radial flange and an annular, radially expansible/contractible, spring interference fit in the annular groove captivating for the coupling nut on the plug connector and including a radially expansible cantilever arm having a locking tab at its end releasably received in one of the ratchet teeth for resisting rotation of the coupling nut relative to the plug connector.

Each ratchet tooth includes an annular face and angularly spaced flanks with one of the flanks being inclined at a greater angle than the other flank, respectively, relative to a radius drawn through the primary axis and the one flank of one ratchet tooth intersecting the other flank of the ratchet tooth adjacent thereto form a V-shaped detent, the locus of intersections forming a circle having a diameter slightly greater than the outer diameter of the spring annulus.

The spring comprises a flat plate of generally rectangular cross-section spiraled about itself more than once to form an annulus defining an opening sized to interference fit about the annular groove, having its flat faces overlapping and its opposite end portions thereof free, the long and short dimensions of the cross-section being disposed radially and longitudinally relative to the connector axis with one end portion of the spring extending tangentially from the annulus to form a cantilever arm with the distal end thereof including the locking tab in a plane disposed substantially perpendicular to the plane of the annulus, the tab being disposed in a plane at an acute-angle relative to a center line drawn through the arm and adapted to seat against the one flank of the ratchet teeth.

Upon application of an external torque to the coupling nut, the flanks are driven against the tab, one flank serving to force the spring ends apart and radially expand the spring annulus from its interference fit whereby the spring will side about the annular groove, the other flank initially serving to force the spring ends together to radially contract the spring annulus and increase the interference fit whereby the spring will not slide relative to the groove and, as a result of an increase in external torque, drive the cantilever arm radially upward and cam the tab radially upward from and out from its detent and onto the annular face whereby the coupling nut will rotate and advance the next ratchet tooth thereto whereupon spring resiliency will drive the locking tab therein and radially contract the spring annulus into its interference fit about the annular groove.

One way of carrying out the invention is described in detail below with reference to the drawings which illustrate one specific embodiment of this invention, in which:

FIG. 2 is a view of the mechanism including a spring having a cantilevered end thereof engaged with ratchet teeth.

FIG. 6 is a view, similar to that of FIG. 3, showing the anti-decoupling mechanism subjected to an external torque nut.

FIG. 7 is an enlarged view of FIG. 6 looking down on disengagement between a locking tab and a ratchet tooth.

Figure 1:
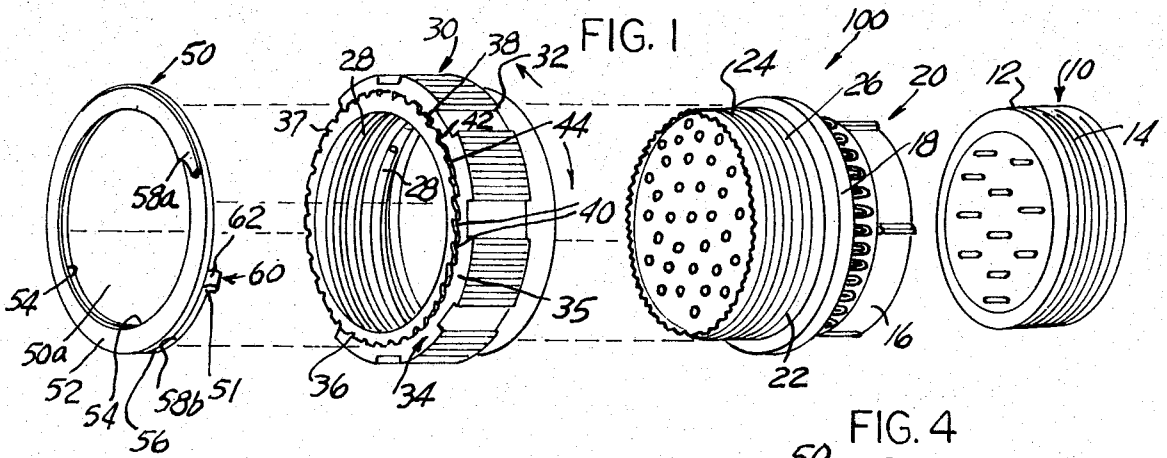
FIG. 1 is an exploded view of an electrical connector assembly having an anti-decoupling mechanism according to the present invention.

Referring now to the drawings, FIG. 1 shows an exploded view of an electrical connector assembly 100 aligned along its primary axis for mating and comprising a receptacle shell 10, a plug shell 20 and a coupling nut 30 rotatably mounted to the plug for connecting with the receptacle. The receptacle shell 10 is generally cylindrical and includes a forward portion 12 provided with thread 14 on its outside periphery. The plug shell 20 is generally cylindrical and includes forward and rearward portions 16, 24, an annular flange 18 disposed medially of shell portions 16, 24 and an annular groove 26 circumjacent annular flange 18, the annular groove 26 having a transverse, forwardly facing, end wall 22 (shown best in FIGS. 4 and 7).

The coupling nut 30 includes a generally cylindrical coupling sleeve 32 having internal thread 28 adapted to engage with the external thread 14 when coupling nut 30 is rotated and a radial flange 34 adapted to seat against annular flange 18 of plug shell 20 for rotation thereabout, the radial flange having a rearwardly facing outer end wall 35 disposed in a plane substantially perpendicular to the connector axis of rotation.

Preferably and in accord with this invention an anti-decoupling and mounting arrangement is provided and comprises a cylindrical hub 36 extending coaxially rearward from outer end wall 35, a contiguous plurality of engageable ratchet teeth 40 disposed annularly around the outer periphery of hub 36 and an annular, radially expansible/contractible spiral spring 50 adapted to be interference fit about annular groove 26 for mounting the coupling nut to the plug shell, the spring annulus including an arm 51 extending tangentially therefrom as a cantilever and including at its distal end a locking tab 60 disposed at an acutely-angle relative to the arm 51 for releasably engaging the ratchet teeth 40 to resist rotation of coupling nut 30 relative to the plug shell 20.

The ratchet teeth 40 are formed annularly around and each extends radially inward of the outer periphery 38 of hub 36. Although integral with the coupling nut the hub 36 could form part of a separate disk secured (or bonded) to end wall 25 of radial flange 34, the hub having an end face 37 spaced from and parallel to end wall 35. The ratchet teeth 40 are generally equiangularly spaced from one another and comprise a pair of angularly spaced flanks 42, 44 and an annular face 38, one flank 44 being inclined at a greater angle than the other flank 42 relative to a radius drawn through the primary axis of the assembly, the outer periphery of hub 36 providing the annular face 38 for the ratchet teeth.

Spring 50 is of a resilient material, such as metal, and comprises a substantially flat plate 52 of generally rectangular cross-section spiraled about itself to form an annulus having opposite ends **58*a*, 58*b*, inner and outer circumferential faces 54, 56 and plate faces overlapping, the inner circumferential face 54 defining a central opening 50*a* of a diameter less than annular groove 26 so as to interference fit therewithin and opposite ends 58*a*, 58*b* allowing the spring annulus to radially expand or contract depending upon whether spring ends 58*a*, 58*b* are driven away from or towards one another by external torques transmitted to the annulus by the arm 51. The arm 51 defines a cantilever extending tangentially from the annulus adjacent end 58*b* of the spring 50 and extending to its distal end to form locking tab 60 adapted to be releasably fit in each of the ratchet teeth 40, the arm 51 being adapted to transmit external torques and be radially expansible to expand the spring annulus. Spring 50 with locking tab 60 serves functions of both captivating (i.e., mounting) coupling nut 30 on plug shell 20 and of resisting unwanted rotation of coupling nut 30 relative to plug shell 20**. When the spring is spiraled, the cross-section has its long and short dimensions, respectively, disposed radially and longitudinally relative to the primary axis.

FIG. 2 shows locking tab 60 of arm 51 disposed between two contiguous ratchet teeth 40 formed radially inward and annularly around the outer periphery 38 of hub 36. Each ratchet tooth includes the annular face 38 and angularly spaced flanks 42, 44, each of the flanks 42, 44 being disposed at acute-angles "D" and "E" relative to a radius drawn through the connector axis. Tab 60 comprises plate 52 being bent perpendicularly to the plane of the annulus and at an acute-angle relative to a center line passing through the cantilever to form an L-shaped end portion 62 configured to seat against the less steeply angled flank 44 and fit between opposing flanks 42, 44 of two adjacent ratchet teeth 40. The adjacent flanks 42, 44 intersect to form a V-shaped detent 43 for locking tab 60 to engage, the locus of flank intersections being disposed around a circle outwardly of the outer circumferential face 56 of spring 50.

Figure 3:
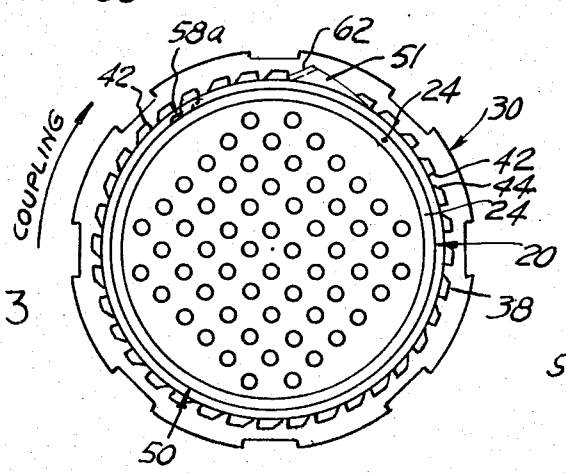
FIG. 3 is an end view of a plug shell provided with the anti-decoupling mechanism subjected to an external coupling torque.

FIG. 3 shows coupling nut 30 mounted to plug shell 20 by spring 50, expansible arm 51 extending as a cantilever from the spring annulus and tab 60 with end portion 62 positioned between two adjacent ratchet teeth 40. The arrow shows the direction of external coupling torque on coupling nut 30 relative to plug shell 20, the external torque tending to drive flank 42 against tab 60 and radially expand the spring annulus.

Figure 4:
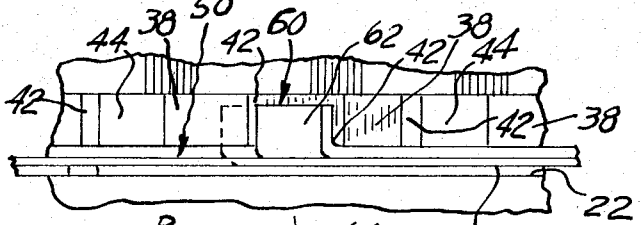
FIG. 4 is an enlarged view of FIG. 3 looking down on engagement between the spring and ratchet teeth.

FIG. 4 shows expansible arm 51 and tab 60 with end portion 62 within the detent between adjacent ratchet teeth with the dotted lines showing the original location of end portion 62 prior to expansion the spring annulus. The opposite ends **58*a*, 58*b* of spring 50 abut end walls 22, 37 and the overlapped plates 52 substantially fill the axial gap between the end walls to prevent any rearward movement of coupling nut 30**.

Figure 5:
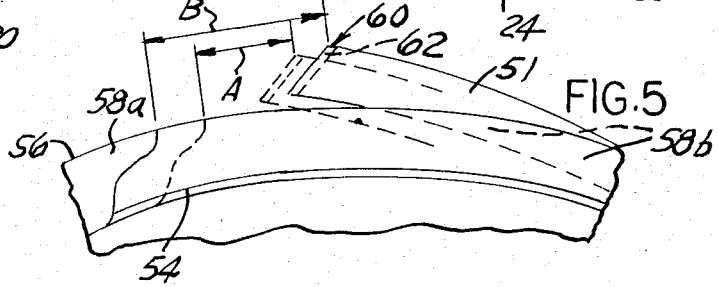
FIG. 5 is a view showing radial expansion of the spring relative to the plug shell.

FIG. 5 shows end portions **58*a*, 58*b* driven radially apart to expand the spring annulus as a result of coupling direction rotation of coupling nut 30 against tab 60 of arm 51 due to an external torque, the dotted lines indicating the original position of the spring annulus when contracted about annular groove 26 and the letters "A" and "B", respectively, representing contracted and expanded positions. When spring 50 is expanded radially, the spring annulus is free to slide about annular groove 26**.

FIG. 6 shows external uncoupling torque on coupling nut 30, the torque rotating coupling nut 30 relative to plug shell 20 and driving the flank 44 against end portion 62 of tab 60. Initially, the flank 44 tends to drive ends **58*a*, 58*b* towards one another and to contract the spring annulus, whereby the frictional forces are increased and the annulus does not rotate. As the external torque increases, flank 44 forces arm 51 to expand radially and tab 62 is driven radially upward from and out of the detent 43 to ride upon annular face 38. The coupling nut is shown to have rotated by an amount "C" relative to the plug shell 20**.

FIG. 7 shows end portion 62 of tab 60 riding annular face 38 as a result of coupling nut 30 rotating.

We claim:

1. An anti-decoupling mechanism for an electrical connector assembly, the connector assembly having a primary axis and comprising a pair of connector members and a coupling nut including a radial flange rotatably mounted to one of the connector members for coupling to the other connector member, said one connector member including an external annular groove having a transverse end wall facing forwardly and said radial flange having an outer end wall facing rearwardly, said anti-decoupling mechanism being adapted to resist both coupling and uncoupling rotation of the coupling nut and characterized by:

a cylindrical hub having an annular face extending coaxially rearward from the outer end wall of said radial flange;

a contiguous plurality of ratchet teeth disposed annularly around said annular face, one respective flank of each adjacent pair of ratchet teeth intersecting to form a detent with the locus of intersected flanks describing a detent circle relative to the axis;

a radially expansible/contractible annular spring sufficiently interference fit within said annular groove to prevent relative rotation therebetween, the outer circumference of said spring annulus being defined by a diameter slightly less than the diameter of the detent circle; and means extending tangentially from and radially expansible within a plane including said spring for expanding said spring and engaging said detents, application to the coupling nut of an external coupling/uncoupling torque radially expanding/contracting said spring to eliminate/increase frictional interference forces acting between the spring annulus and said annular groove, radial expansion allowing said spring to slide relative to said annular groove and radial contraction initially increasing the frictional interference forces preventing relative rotation until a sufficient external torque drives the expanding means radially outward of its detent whereby the coupling nut rotates and advances the next successive detent whereupon said spring radially contracts back into its interference fit about the annular groove.

2. The anti-decoupling mechanism as recited in claim 1 wherein said expanding and engaging means comprises an arm continuing as a cantilever tangentially from said spring annulus and a locking tab for releasably engaging respective of said detents, said tab being dimensioned to extend radially between the detent circle and the annular face with external torque against the tab by one of said flanks driving the arm radially outward and by the other of said flanks radially expanding the spring annulus.

3. The anti-decoupling mechanism as recited in claim 2 wherein said spring is comprised of a substantially flat plate of generally rectangular cross-section and having opposite ends free, said plate being spiraled about itself more than once such that said plate has its faces overlapping and said cross-section has its long and short dimensions, respectively, disposed radially and longitudinally relative to the axis.

4. The anti-decoupling mechanism as recited in claim 1 and further characterized in that said hub is bonded to the exterior of said radial flange.

5. The anti-decoupling mechanism as recited in claim 2 wherein each of said ratchet teeth includes a pair of angularly spaced flanks that terminate on said annular face with one said flanks being inclined at a greater angle than the other of said flanks, respectively, relative to a radius through the primary axis, said annular face being coaxial with the detent circle and extending from detent-to-detent whereby to provide a race for the locking tab to ride upon when cammed radially outwardly of its detent during uncoupling rotation of coupling nut.

6. The anti-decoupling mechanism as recited in claim 2 wherein one tab is integrally formed with and is disposed at the end of said deflectable arm, said tab comprising a flat plate extending substantially perpendicularly from the plane of the spring annulus and inclined at an angle relative to a radius through the axis, said flat plate being so inclined as to abut said one flank.

* * * * *